US009192255B2

(12) United States Patent
Burrous et al.

(10) Patent No.: US 9,192,255 B2
(45) Date of Patent: Nov. 24, 2015

(54) ILLUMINABLE DOUBLE-SIDED FRAME ARRANGEMENT

(71) Applicant: Rose Displays Ltd, Salem, MA (US)

(72) Inventors: Thomas P. Burrous, Haverhill, MA (US); Erik G. Zelbacher, Lynn, MA (US); Rebecca A. Suciu, Lynn, MA (US); Paul P. Ellsworth, Burlington, MA (US); Alan L. Stenfors, Scituate, MA (US); Sidney Rose, Marblehead, MA (US)

(73) Assignee: Rose Displays Ltd., Salem, MA (US)

( * ) Notice: Subject to any disclaimer, the term of this patent is extended or adjusted under 35 U.S.C. 154(b) by 38 days.

(21) Appl. No.: 13/998,327

(22) Filed: Oct. 21, 2013

(65) Prior Publication Data

US 2015/0107142 A1 Apr. 23, 2015

Related U.S. Application Data

(63) Continuation-in-part of application No. 13/986,248, filed on Apr. 15, 2013, now Pat. No. 9,038,301.

(51) Int. Cl.
*G09F 13/18* (2006.01)
*A47G 1/06* (2006.01)

(52) U.S. Cl.
CPC ..... *A47G 1/0622* (2013.01)

(58) Field of Classification Search
CPC ..... G09F 15/0012; G09F 1/12; A47G 1/0622; A47G 1/0605; A47G 1/06; A47G 1/10
USPC ..... 40/714, 780, 782
See application file for complete search history.

(56) References Cited

U.S. PATENT DOCUMENTS

| | | | | | |
|---|---|---|---|---|---|
| 3,698,114 | A | * | 10/1972 | Hirsch et al. | 40/782 |
| 3,883,974 | A | * | 5/1975 | Ashton | 40/766 |
| 3,955,298 | A | * | 5/1976 | Kapstad | 40/782 |
| 4,283,870 | A | * | 8/1981 | Stetler | 40/791 |
| 4,630,386 | A | * | 12/1986 | Wilson | 40/734 |
| 4,726,133 | A | * | 2/1988 | Rainone et al. | 40/780 |
| 4,862,612 | A | * | 9/1989 | Sugihara et al. | 40/782 |
| 5,187,886 | A | * | 2/1993 | Wu et al. | 40/759 |
| 5,265,357 | A | * | 11/1993 | Yu | 40/714 |
| 5,313,724 | A | * | 5/1994 | Warner | 40/714 |
| 5,367,801 | A | * | 11/1994 | Ahn | 40/714 |
| 5,377,434 | A | * | 1/1995 | Wilson | 40/611.06 |
| 5,408,771 | A | * | 4/1995 | Manrubia | 40/714 |
| 5,419,064 | A | * | 5/1995 | Bennett | 40/782 |
| 5,479,733 | A | * | 1/1996 | Kusina | 40/785 |
| 5,546,687 | A | * | 8/1996 | Iorfida | 40/546 |

(Continued)

*Primary Examiner* — Shin Kim
(74) *Attorney, Agent, or Firm* — Don Halgren

(57) ABSTRACT

A multi-component frame assembly for the display of at least one illuminable graphic panel. The frame assembly includes a frame made of at least one single frame member and at least one split rail frame member, which are joined together by a plurality of connecting brackets. The split rail frame member is comprised of an elongated first side split rail and an elongated second side split rail separated apart by a mid rail member disposed therebetween. The at least one single frame member has a cross-sectional configuration of "U" shape, and is comprised of an exterior bridge member and an interior bridge member for supporting strips of light emitting diodes. The interior bridge member has a bracket channel on one side of the interior bridge member and a graphic receiving channel on the other side of the interior bridge member to enable receipt of one or more graphic display panels.

30 Claims, 20 Drawing Sheets

(56) References Cited

U.S. PATENT DOCUMENTS

| | | | | | |
|---|---|---|---|---|---|
| 5,555,654 | A * | 9/1996 | Hermann | 40/714 |
| 5,617,660 | A * | 4/1997 | Pollack | 40/606.17 |
| 5,621,994 | A * | 4/1997 | Cobb et al. | 40/782 |
| 5,799,430 | A * | 9/1998 | Fremstad | 40/785 |
| 5,806,256 | A * | 9/1998 | Byrne | 52/204.5 |
| 5,911,525 | A * | 6/1999 | Jepsen et al. | 40/611.06 |
| 6,076,295 | A * | 6/2000 | Garfinkle | 40/605 |
| 6,101,753 | A * | 8/2000 | Shieh | 40/782 |
| 6,339,891 | B1 * | 1/2002 | Cox | 40/785 |
| 6,928,762 | B1 * | 8/2005 | Fattahi | 40/741 |
| 7,313,880 | B2 * | 1/2008 | Yamagishi | 40/782 |
| 8,151,500 | B2 * | 4/2012 | Lin | 40/546 |
| 8,627,589 | B2 * | 1/2014 | Pitcher et al. | 40/785 |
| 8,707,597 | B1 * | 4/2014 | Cavalieri | 40/611.06 |
| 2010/0307041 | A1 * | 12/2010 | Tian et al. | 40/575 |
| 2011/0030252 | A1 * | 2/2011 | Marinakis | 40/549 |

* cited by examiner

14

180

ILLUMINABLE DOUBLE-SIDED FRAME ARRANGEMENT

BACKGROUND OF THE INVENTION

This invention relates to frame assemblies and more particularly to two sided frame arrangements which permit display panels to be entered, illuminated and readily changed for efficient commercial advertising purposes, and is a continuation-in-part application of our pending U.S. patent application Ser. No. 13/986,248, filed Apr. 15, 2013, and incorporated herein by reference in its entirety.

DISCUSSION OF THE PRIOR ART

The retail sales industry requires conspicuous advertising at every possible location in a commercial establishment. Such advertising should also be presented in an attractive and noticeable manner. Other requirements of such advertising are the enablement of such advertising to be changed easily, and often frequently.

Clearly, the more conspicuous that advertising is, the most successful it may be. Illumination is one approach to making such advertising successful. However most illuminated advertising is a direct lighting or edge illuminated displays.

It is an object of the present invention to overcome the disadvantages of the prior art.

It is another object of the present invention to provide a frame assembly which is capable of displaying an illuminable advertising panel on a front side and if desired, the same or an alternative on a rear side of the frame assembly.

It is a further object of the present invention to provide a frame assembly capable of illuminating one or more panel displays from an edge configuration or from a backlit configuration or a combination thereof.

BRIEF SUMMARY OF THE INVENTION

The present invention relates to a multi-component frame arrangement assembly for holding and displaying one or more graphic panels which may be slid in from one side, or from two or three sides or just from the top side thereof. The frame assembly in a first preferred embodiment comprises a rectilinear array of single frame members, one each arranged on three sides, as for example, on the left edge side, the right edge side and the lower edge side. The frame assembly in this first preferred embodiment has a fourth edge which in one preferred embodiment is an upper edge side comprised of a split frame member arrangement. The split frame member may be arranged at the upper edge as shown in this embodiment, or one or both sides thereof in other embodiments.

Each single frame member in cross section is generally of U-shape. The single frame member comprises an elongated exterior bridge which is co-extruded with a first elongated side portion and a second elongated side portion. The exterior bridge portion lies in a plane which in one preferred embodiment, to facilitate design considerations for presentation of a display panel, is arranged at an acute angle with respect to the plane of the second elongated-side-portion as well as at an acute angle with the plane of the first elongated-side-portion. The elongated second side portion has an elongated distalmost edge with an inwardly extending flange arranged thereon. The elongated first side portion has an elongated distalmost edge within inwardly extending flange arranged thereon.

An elongated interior bridge member extends within the single frame member, co-extensively with the exterior elongated bridge member. An elongated securement channel is arranged co-extensively long the interior bridge member, which securement channel faces the inner side of the exterior bridge member.

The interior bridge member has a second side interior shoulder and a first side interior shoulder which further comprises and are each respectively joined to an elongated support member which is connected to the inside respectively, of the elongated second side portion and the elongated first side portion. The support member for the interior bridge on each side thereof, may in one preferred embodiment be of stepped panel supporting configuration. The elongated second side member has a first end with an inwardly directed elongated, generally L-shaped bracket extending thereon.

The elongated support or stepped member connected to the inside of the elongated second side member defines an L-shaped member which faces the L-shaped member extending on the first end thereof. The space between the L-shaped flange near the first end of the elongated rear side and the generally L-shaped member extending from the stepped configuration of the off of the interior bridge member defines a bracket receiving channel for one side portion of the single frame member.

The elongated second side member has a first end with an inwardly directed elongated, generally L-shaped bracket extending thereon.

The elongated stepped member connected to the inside of the elongated front-side member defines an L-shaped member which faces the L-shaped member extending on the first end thereof. The space between the L-shaped flange near the first end of the elongated front side and the generally L-shaped member extending from the stepped configuration off of the interior bridge member defines another bracket receiving channel for the single frame member.

The second side interior shoulder and the first side interior shoulder each extend toward the elongated opening of the single frame member, and have an elongated second side guide and an elongated first side guide disposed co-extensively therealong. The elongated second side guide and the elongated first side guide have an elongated second inner landing and an elongated first inner landing respectively. The elongated second inner landing and the elongated first inner landing are arranged opposed to one another with an elongated gap disposed therebetween. The stepped configuration adjacent to the second side guide and the first side guide on each respective sides of the single frame member defines an elongated graphic display receiving space, as will be described more fully hereinbelow.

The split frame member arrangement, which in one preferred embodiment, comprises at least one side component of the frame assembly, but could be two or three sides thereof in further aspects of the present invention, consists of a elongated second-side split rail and an elongated first-side split rail separated by and spaced apart from, a rectilinear mid-rail member. The elongated second side split rail has a first edge which in one preferred embodiment, for design purposes, may be of generally a "J"-shape, and an elongated second edge which has an elongated flange extending inwardly thereon. The elongated first-side split rail similarly has both a first edge which in one embodiment is of generally a "J"-shape, and has an elongated second edge which has an elongated flange extending inwardly thereon. The elongated second-side split rail has a generally "L"-shaped flange extending from an inner side of the second side split rail, adjacent the first edge thereof. The elongated second side split rail also has a generally L-shaped flange extending from an inner side of the second side split rail adjacent the second edge thereof. The elongated space between the two generally L-shaped flanges on the inner side of the second-side split rail defines one of the two corner bracket receiving channels for the split rail member. The elongated second-side split rail and the elongated first-side split rail are in fact mirror images of one another.

The elongated mid-rail member is of generally "U"-shape in cross section. The mid-rail member has an exterior bridge at a first end thereof which exterior bridge joins an elongated rear side and an elongated front side thereof. The elongated rear side and the elongated front side of the mid rail member is also joined by an interior bridge extending therebetween. The interior bridge has a securement channel co-extruded therewith, on one side thereof, for receipt of for example, a bolt, a screw or locking pin or the like. The elongated second side of the mid-rail member as an inwardly extending second inner landing arranged thereon. The elongated first side of the mid-rail member has an inwardly extending first inner landing arranged thereon. The inner landing of the elongated second side and the inner landing of the elongated first side are opposed to and are spaced apart from one another. The second side elongated split rail, the mid-rail member and the first side elongated split rail are all supported parallel to and spaced apart from one another by corner brackets, as will be shown and described further hereinbelow.

In yet a further aspect of the present invention, a strip of light emitting diodes may be adhered to an outwardly directed side of the second inner landing and the first inner landing of one or more of the single frame members comprising the frame assembly. The open elongated chamber between the interior bridge member and the second inner landing and the first inner landing of the single frame member is arranged to define a wire routing channel within each single frame member. The elongated space between the second side guide and the first side guide of each single frame member defines a support enclosure for one or more illuminable panels and/or a middle reflector panel to be utilized within the frame assembly.

A further aspect of the present invention includes a light emitting diode strip arranged on the outwardly directed sides of the second inner landing in the first inner landing of the mid-rail members. A wire routing channel comprises the space between the interior bridge and the second inner landing and the first inner landing of the mid-rail member which is utilizable for a power circuit for a strip of light emitting diodes utilized with the split rail frame member arrangement.

In a further embodiment, the assembly may in one embodiment, include an internal elongated divider rail which accepts the display panel, graphics and an arrangement of LED strips on one or both sides thereof, and allow for multiple panels to be illuminated with graphics that may be individually changed.

Assembly of the multi-component frame arrangement is accomplished in this embodiment, by providing a mitered end (for example, a 45 degree cut on a four sided frame) on each of the single frame members and on each end of the split rail frame member arrangement. In other embodiments, the angle may vary. A pair of "L"-shaped corner brackets are placed in the respective bracket receiving channels of the single frame members and their respective adjacent either single frame members or elongated first side split rail and the elongated second side split rail corner bracket receiving channels. Securement members such as for example, a bolt, a screw or locking pin or the like may be placed through the respective ends of a single frame member into adjacent single frame member securement channels and between the mid-rail member and adjacent single frame members so as to ensure their structural integrity.

The invention thus comprises a multi-component frame assembly arrangement for the display of at least one graphic panel slidably insertable and removable with respect thereto, the frame assembly arrangement comprising: a frame perimeter comprised of at least one single frame member and at least one split rail frame member arrangement, wherein the at least one single frame member and the at least one split rail frame member arrangement are joined together by a plurality of connecting brackets; the at least one single frame member having a cross-sectional configuration of generally "U" shape, and being comprised of an exterior bridge member and an interior bridge member; the interior bridge member having a stepped configuration so as to form a bracket channel on one side of the interior bridge member and a graphic receiving channel on the other side of the interior bridge member, including a second side guide and a first side guide extending therefrom to enable secure receipt of at least one illuminable panel therewithin, wherein the second side guide and the first side guide each have an inner landing extending therealong, wherein the second side guide and the first side guide are each arranged to support an elongated strip of light emitting diodes thereagainst, wherein the interior bridge member includes a securement receiving channel and wherein the at least one split rail member is comprised of a elongated second side split rail and elongated first side split rail and a mid-rail member disposed therebetween.

The elongated second side split rail is supportively disposed in a spaced-apart manner from the mid-rail member, to enable a graphic display panel to be inserted therebetween. The elongated first side split rail is supportively disposed in a spaced-apart manner from the mid-rail member, to enable a graphic display panel to be inserted therebetween.

The mid-rail member includes an exterior bridge and an interior bridge having a securement channel co-extruded therewith. The interior bridge of the mid-rail member has a mid-member second side guide and a mid-member first side guide. The second side guide and the first side guide each have an inner landing member extending towards one another. The inner landing member of both the second side guide and the first side guide in one embodiment commonly support an elongated strip of light emitting diodes. The interior bridge of the mid-rail member and the inner landings thereadjacent define an elongated space wherein one or more of the rails, in one preferred embodiment, may be utilized for a contiguous wire connector arrangement to empower one or more strips of light emitting diodes.

The elongated second side split rail and the elongated first side split rail are mirror images of one another. The elongated second side split rail preferably has a pair of generally L-shaped flanges on an inner side thereof to define a corner bracket receiving channel therebetween to enable corner bracket attachment to an adjacent single frame member. At least one graphic panel is placable within the frame assembly arrangement and slid into a graphic receiving channel arranged on at least one single frame member.

The invention also comprises a method of illuminably displaying at least one graphic panel in a frame assembly comprising the steps of connecting at least one split frame member to at least two single frame members by connector brackets inserted into connector receiving channels on each end of the at least one split frame member and the at least two single frame members; attaching at least one strip of lightable diodes to an elongated landing on at least one of the single frame members; inserting a graphic display into an elongated opening in a split frame member on at least one side of the frame assembly, wherein the frame assembly consists of a frame perimeter comprised of at least one single frame member and at least one split rail frame member arrangement, wherein the at least one single frame member and the at least one split rail frame member arrangement are joined together by the connecting brackets, and the at least one single frame member having a cross-sectional configuration of generally "U" shape, and being comprised of an exterior bridge member and an interior bridge member; the interior bridge member having in one embodiment, a segmented or stepped configuration so as to form a bracket channel on one side of the interior bridge member and a graphic receiving channel on the other side of the interior bridge member.

The invention also comprises a method of illuminably displaying at least one graphic panel in a illuminable frame assembly comprising connecting at least one split frame member at both of its respective ends thereof, to a single-frame member, wherein the at least one split frame member consists of a first side elongated split rail and a second side elongated split rail each held in a graphic-display entrance-permitting spaced-apart relationship, with respect to and parallel to an elongated intermediately-disposed mid-rail member to provide two elongated access slots for one or two graphic displays therewithin; wherein the at least two single frame members solidly connect to the first and second side elongated split rail each by a connector bracket inserted into a respective connector receiving channel on each end of the at least one spilt frame member of the at least two single frame members, wherein the at least one mid-rail member is solidly connected to the single frame members by securement means at each end, and attaching at least one elongated strip of graphic display enhancing lightable diodes to an elongated landing on at least one inwardly facing portion of at least one of the frame members.

The method preferably also includes arranging a reflector panel interiorly supported by the single frame members to provide light reflection and light directional control within the frame assembly relative to a graphic display therewithin, The method may include placing an illuminable panel adjacent the reflector panel within the frame assembly, and sliding a graphic display into an elongated opening between a first and/or second side elongated split rail and the mid-rail member so as to be captured within an elongated light-enhanceable graphic-receiving-space in a single frame member. The method may include energizing the light diodes so as to illuminate at least one side of the graphic display within the frame assembly.

The invention also comprises a four sided frame display system for displaying at least two illuminable display panels, the frame display system comprising: at least one single-frame member and at least one split-frame member connected together and comprising two of the four sides of the four sided frame display system, wherein the split frame member has a pair of parallel slots which permit entry and removal of the one or more display panels, and the at least one single-frame member has at least two shouldered slots for receipt of the one or more display panels; and wherein an elongated array of lights is arranged on a pair of spaced apart inner landings to provide illumination of the one or more display panels supported in the system A pair of elongated side guides within the single-frame member support a reflector panel sandwiched between a pair of illuminable panels, which are sandwiched between the one or more display panels within the system. The elongated array of lights are arranged adjacent at least one side of the illuminable panels. The at least one split-frame member and the at least one single-frame member have a common overall peripheral configuration. The at least one mid rail split-frame member and the at least one single-frame member have an interior bridge member which includes a centrally disposed securement channel for connecting the at least one mid rail member to the at least one single-frame member. The respective one or more display panels are supported in a spaced-apart orientation from their inwardly adjacent illuminable panels. A cross member may be arranged to subdivide the frame display system into multiple display panel supports. The cross member is comprised of two "H" configurations having a common bridge portion. The two "H" configuration of the cross member has parallel spaced apart flanges for receipt of individual display panels.

BRIEF DESCRIPTION OF THE DRAWINGS

The objects and advantages of the present invention will become more apparent, when viewed in conjunction with the following drawings, in which:

FIG. 19 is a edge view of the second edge of the elongated rear side split rail shown in FIG. 17;

DETAILED DESCRIPTION OF THE DRAWINGS

Figure 1:
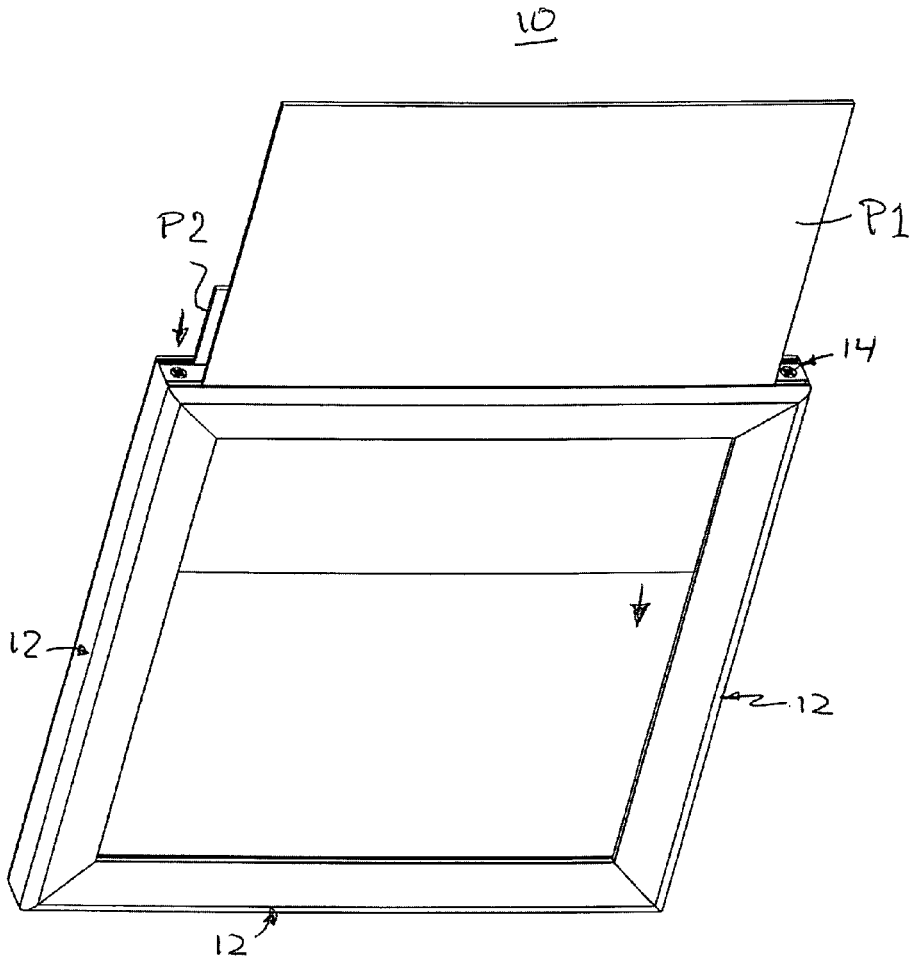
FIG. 1 is a perspective view of a multi-component frame assembly arrangement constructed according to the principles of the present invention, showing a first and a second graphic display being placed within their respective front and rear entry portions of that frame assembly.

The present invention relates to a multi-component frame arrangement assembly 10 for holding and displaying one or more graphic panels P1 and P2 which may be slid in from the side or from the top thereof, as represented in FIG. 1. The frame assembly arrangement 10 in a first preferred embodiment comprises a rectilinear array of single frame members 12, one each arranged on the three sides, for example, as represented on the left edge side, the right edge side and the lower edge side, as shown in FIG. 1. The frame arrangement assembly 10 in this first preferred embodiment has for example, a fourth edge comprised of a split frame member arrangement 14, which is shown at an upper edge, but may be arranged at one or both sides thereof in other embodiments.

Figure 2:
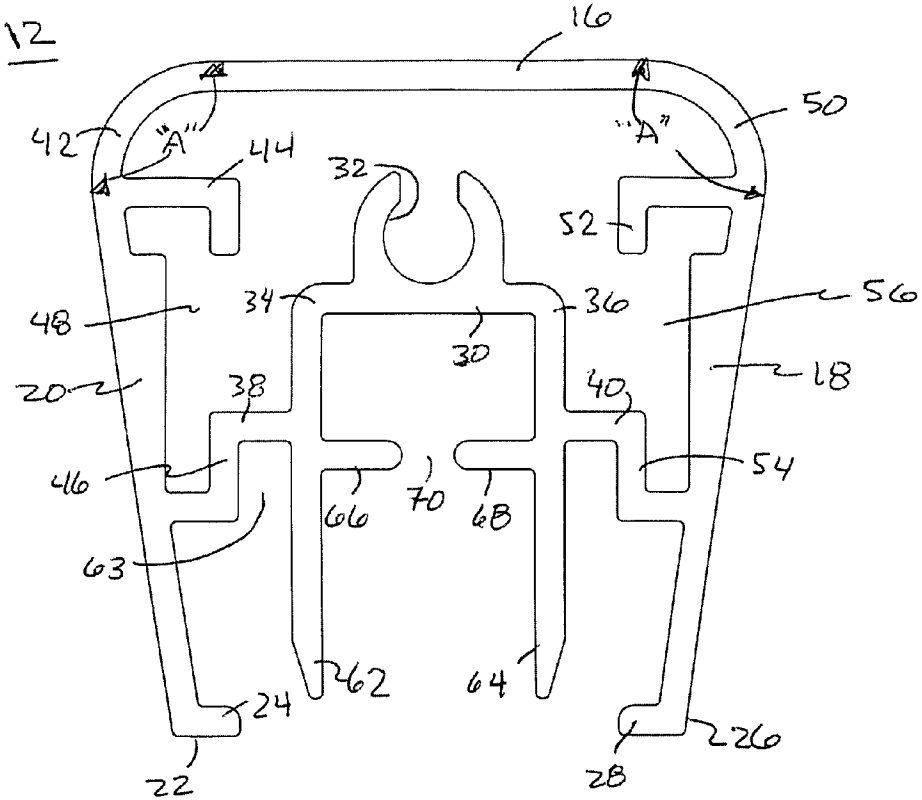
FIG. 2 is an end view of a single frame member component of the present invention.

Each single frame member 12, in cross section is generally of U-shape, as may be seen in FIG. 2. The single frame member 12 comprises an elongated exterior bridge 16 which is co-extruded with an elongated first or front side portion 18 and an elongated second or rear-side portion 20. The exterior bridge portion 16 has a plane which in one preferred embodiment, is arranged for example, at an acute angle "A" with respect to the plane of the second elongated-side-portion 20 as well as at an acute angle "A" with the plane of the first elongated-side-portion 18. The second elongated side portion 20 has an elongated distalmost edge 22 within the inwardly extending flange 24 arranged thereon, as may be seen in FIG. 2. The first or front elongated side portion 18 has an elongated distalmost edge 26 within inwardly extending flange 28 arranged thereon, as likewise may be seen in FIG. 2.

An elongated interior bridge member 30 extends within the single frame member 12, co-extensively with the exterior elongated bridge member 16. An elongated securement-member-receiving channel 32 is arranged co-extensively along the interior bridge member 30, which securement member receiving channel 32 faces the inner side of the exterior bridge member 16 as may be seen in FIG. 2.

The interior bridge member 16 comprises a rear side interior shoulder 34 and a front side interior shoulder 36 which are each respectively joined to and have extend therefrom an elongated support member 38 and 40 which is connected to the inside respectively, of the rear elongated side portion 20 and the front elongated side portion 18, as is shown in FIG. 2. The support members 38 and 40 may preferably be of stepped configuration in one embodiment. The elongated second or rear side member 20 has a first end 42 with an inwardly directed elongated, generally L-shaped bracket 44 extending thereon.

The elongated stepped member 38 connected to the inside of the elongated second or rear-side member 20 defines an L-shaped member 46 which faces the L-shaped member 44 extending on the first end 42 thereof. The space 48 between the L-shaped flange member 44 near the first end 42 of the elongated second side 20 and the generally L-shaped member 46 extending from the stepped configuration 38 off of the interior bridge member 30 defines a bracket receiving channel for the single frame member 12.

The elongated first or front side member 18 has a first end 50 with an inwardly directed elongated, generally L-shaped bracket 52 extending thereon, as may be seen in FIG. 2.

The elongated stepped member 40 connected to the inside of the elongated front-side member 18, as shown in FIG. 2, defines an L-shaped member 54 which faces the L-shaped member 52 extending inwardly on the first end 50 thereof. The space 56 between the L-shaped flange 52 near the first end 50 of the elongated first side 18 and the generally L-shaped member 54 extending from the stepped configuration 40 off of the interior bridge member 30 defines another bracket receiving channel (56) for the single frame member 16.

Figure 3:
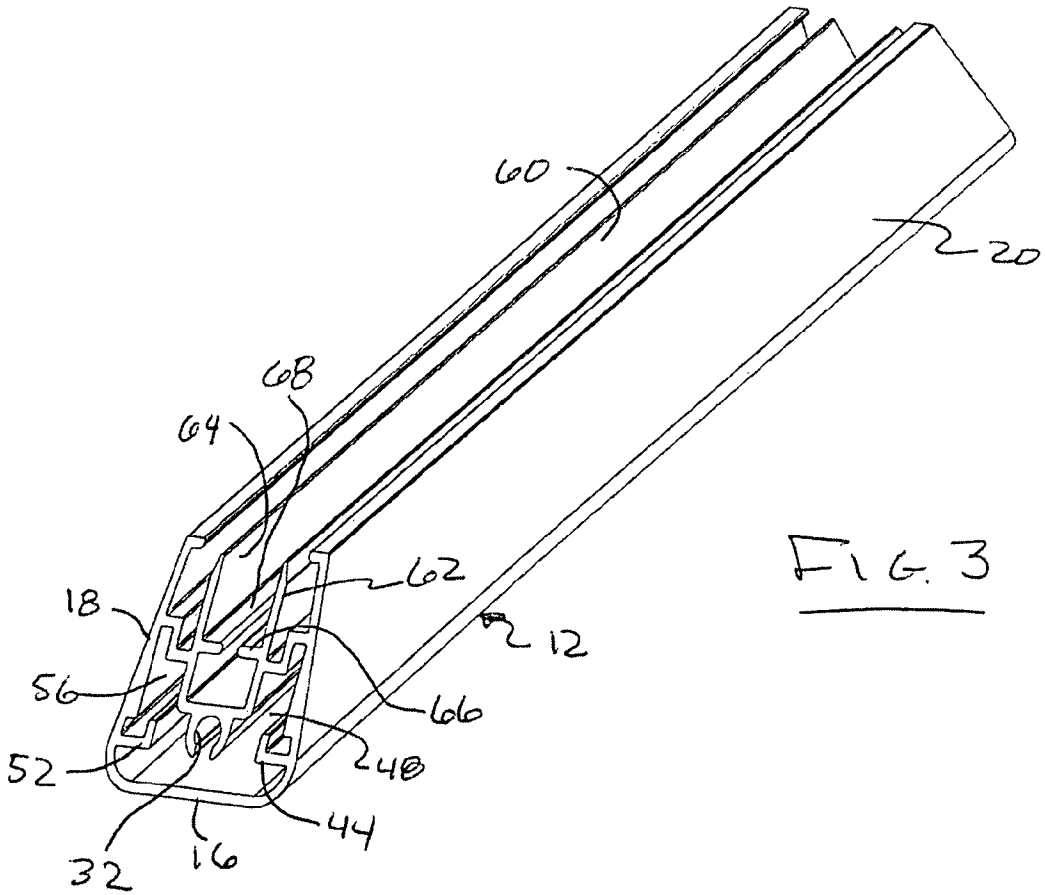
FIG. 3 is a perspective view of the single frame member component shown in FIG. 2 with a mitered end thereon.
Figure 8:
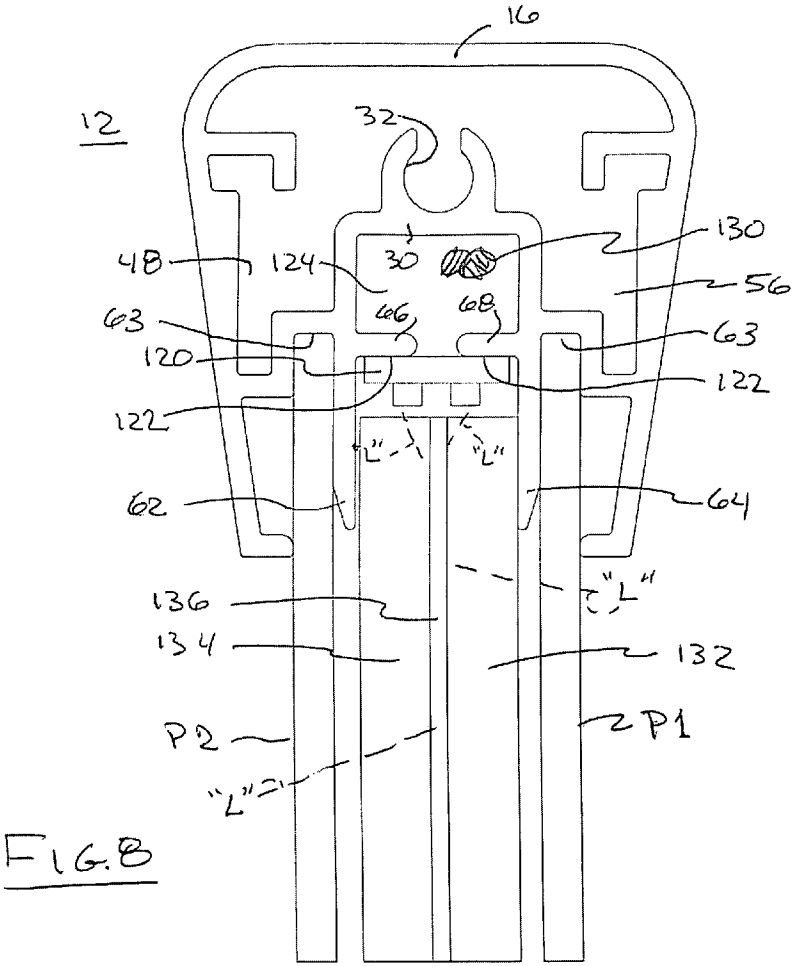
FIG. 8 is an end view of a single frame member component similar to that shown in FIG. 2, with a front and a rear graphic display, a light emitting diode attached there within, and a pair of illuminable panels separated by a middle reflector panel.

The second or rear side interior shoulder 34 and the first or front side interior shoulder 36 each extend toward the elongated opening 60 of the single frame member 12, and have an elongated illuminable-panel supporting rear side guide 62 and an elongated illuminable-panel supporting first or front side guide 64 disposed co-extensively therealong, as represented in an end view in FIGS. 2 and 8, and in a perspective view shown in FIG. 3. The elongated second or rear side guide 62 and the elongated first or front side guide 64 have an elongated, light-strip-supporting rear inner landing 66 and an elongated, light-strip-supporting first or front inner landing 68 respectively, as shown in FIGS. 2, 3 and 8. The elongated rear inner landing 66 and the elongated front landing 68 are arranged opposed to one another with an elongated, electrical-conduit-accommodating gap 70 disposed therebetween, as represented in FIGS. 2 and 8. The stepped configuration members 38 and 40 adjacent to the rear side guide 62 and the front side guide 64 on each respective sides of the single frame member 12 defines an elongated graphic display receiving space 63. The stepped configuration members 38 and 40 thus effectively establishing a bracket channel 48 and 56 respectively on one side of the stepped configuration members 38 and 40, and a graphic receiving channel 63 on the other side thereof, as represented in FIGS. 2 and 8.

Figure 4:
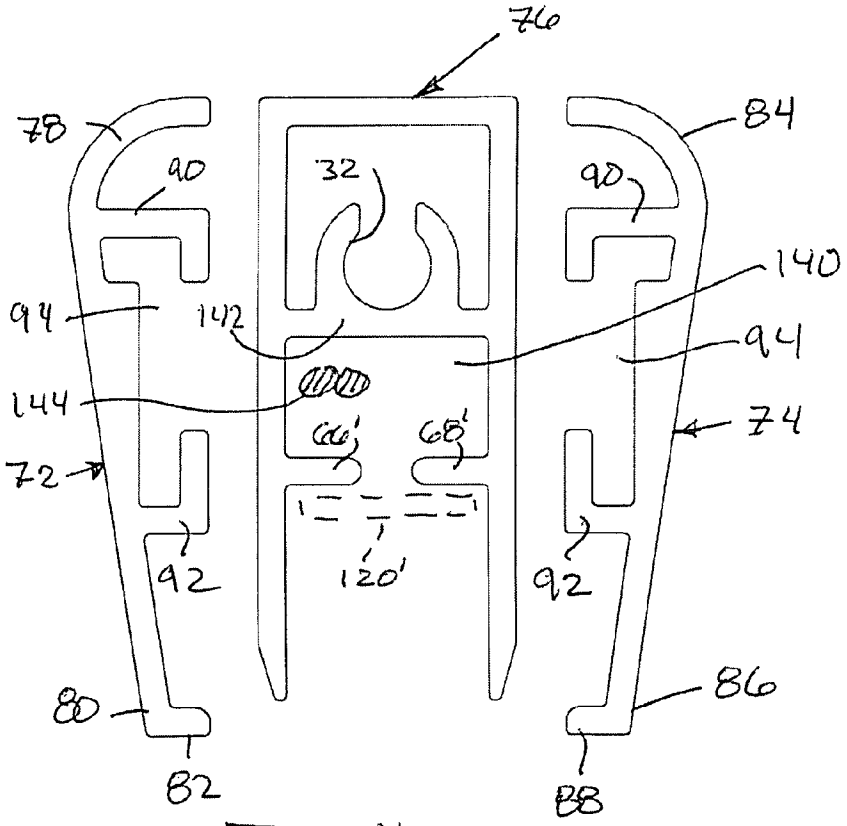
FIG. 4 is an end to view of a split rail frame member arrangement of the present invention showing an elongated rear side split rail, an elongated front side split rail, both separated and spaced apart, with a mid-rail member disposed therebetween.
Figure 7:
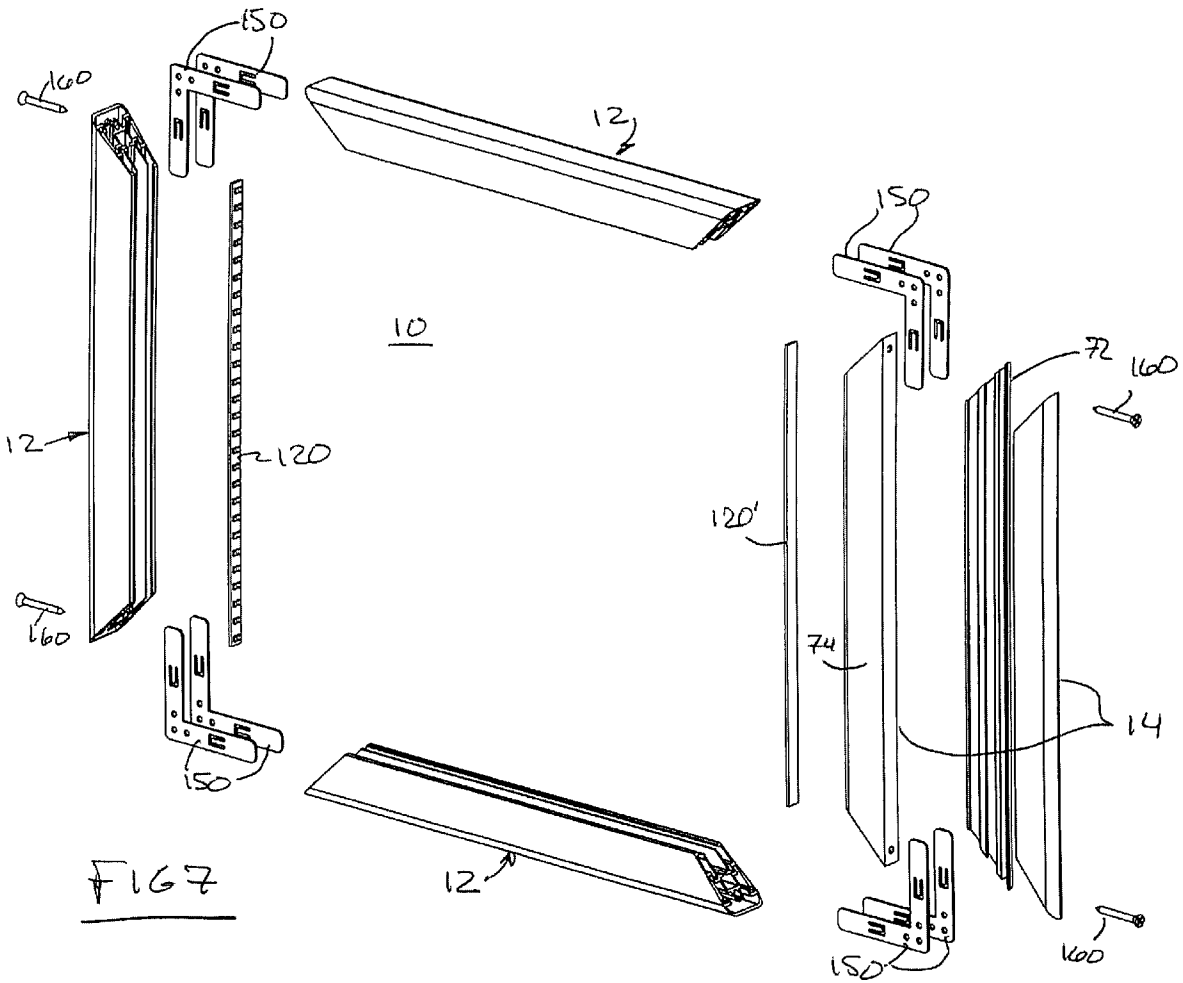
FIG. 7 is an exploded view showing the multi-component frame assembly arrangement, illustrating the corner brackets and the light emitting diode strips embodied therewith.

The split frame member arrangement 14, as shown in FIGS. 1 and 4, which in one preferred embodiment, comprises at least one side of the frame assembly 10, as represented in FIGS. 1 and 7, consists of a elongated second or rear-side split rail 72 and an elongated first or front-side split rail 74 separated by and spaced apart from, a rectilinear mid-rail member 76 to permit one or two displays P1 and/or P2 to be inserted or removed therebetween, as represented in FIG. 1. The elongated second or rear-side split rail 72 has a first edge 78 which in one preferred embodiment, for design purposes, is of generally a "J"-shape, and an elongated second edge 80 which has an elongated flange 82 extending inwardly thereon, as best shown in FIG. 4. The elongated first-side split rail 74 has a first edge 84 which is in one preferred embodiment, for design purposes, is of generally a "J"-shape, and has an elongated second edge 86 which has an elongated flange 88 extending inwardly thereon, as best represented in FIG. 4. The elongated second or rear-side split rail 72 has a generally "L"-shaped flange 90 extending from an inner side of the second side split rail 72, adjacent the first edge 78 thereof, as shown in FIG. 4. The elongated second side split rail 72 also has a generally L-shaped flange 92 extending from an inner side of the second side split rail 72 adjacent the second edge 80 thereof, as best shown in FIG. 4. The elongated space 94 between the two generally L-shaped flanges 90 and 92 on the inner side of the second-side split rail 72 defines a corner bracket receiving channel (94). In a further embodiment, not shown for clarity of viewing, the respective flanges 90 and 92 could be fully connected to define the receiving channel 94. The elongated second-side split rail 72 and the elongated front-side split rail 74 are in fact mirror images of one another, as may be seen in FIG. 4, and are numbered accordingly for convenience of viewing.

Figure 5:
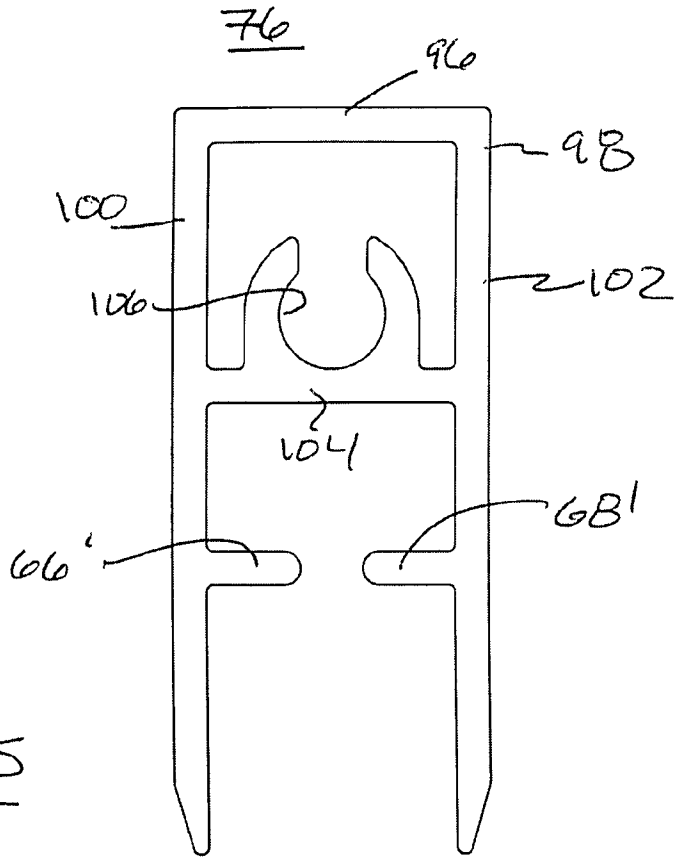
FIG. 5 is an end view of the mid-rail member shown in FIG. 4.
Figure 6:
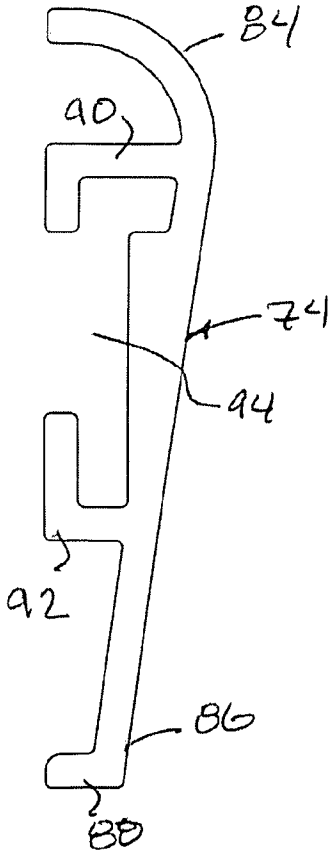
FIG. 6 is an end view of the elongated front side split rail shown in FIG. 4.

The extruded elongated mid-rail member 76 is of generally "U"-shape in cross section, as shown in FIGS. 4 and 5. The mid-rail member 76 has an exterior bridge 96 at a first or outer end 98 thereof, which exterior bridge 96 joins an elongated second or rear side 100 and an elongated first or front side 102 thereof. The elongated second side 100 and the elongated first side 102 of the mid rail member 76 is also joined by an interior bridge 104 extending therebetween, as represented in FIGS. 4 and 5. The interior bridge 104 has a securement channel 106 co-extruded therewith, on one side thereof. The elongated second side 100 of the mid-rail member 76 as an inwardly extending second inner landing 108 arranged thereon. The elongated first side 102 of the mid-rail member 76 has an inwardly extending first or front inner landing 68' arranged thereon. The inner landing 66' of the elongated second side 100 and the inner landing 110 of the elongated first side 102 are opposed to and spaced apart from one another, as shown in FIGS. 4 and 5. The second side elongated split rail 72, the mid-rail member 76 and the first side elongated split rail 74 are all supported parallel to and spaced apart from one another to permit the loading and or unloading of the display panels P1 and/or P2 (as shown in FIG. 1), as represented in FIG. 4, by a mated pairing of corner brackets 150, between adjacent single frame members 12 and the split frame member(s) 14, as may be seen in FIG. 7.

In yet a further aspect of the present invention, a strip of light emitting diodes 120 may be adhered to and supported on an outwardly directed side 122 of the second inner landing 66 and the first inner landing 68 of one or more of the single frame members 12 (and/or the split frame members 14) comprising the frame assembly 10. The open elongated chamber 124 between the interior bridge member 30 and the second inner landing 66 and the first inner landing 68 of the single frame member 12 is arranged to define a confined, conduit-retaining, collectively full peripheral or singularly partially peripheral channel for routing electrical conduits or wires 130 within each single frame member 12, as represented in FIG. 8. The light emitting diodes 120 may be connected to and powered by a battery or an outside electrical source not shown. The elongated space between the second or rear side guide 62 and the first or front side guide 64 of each single frame member 12 defines a support enclosure for one or more illuminable panels 132 and 134 and/or a middle reflector panel 136 to be utilized within the frame assembly 10, as represented in FIG. 8. The middle panel 136 in several embodiments could be clear, mirrored, diffusive so as to reflect disperse/spread or restrict or color/limit/focus or spread rays of light rays "L" through or to one or both sides of the frame arrangement assembly 10, as represented by the dashed lines "L" in FIG. 8 depending upon the nature/color/light directing shape or finish thereof.

The aspect of the present invention showing a light emitting diode strip 120 in phantom, arranged on the outwardly directed sides 122 of the second or rear inner landing 66' and the first or front inner landing 68' of the mid-rail members 76 is represented in FIG. 4. An electrical conduit or wire routing channel 140 comprises the space between the interior bridge 142 and the second or rear inner landing 66' and the first or front inner landing 68' of the mid-rail member 76 which is utilizable for a power circuit for the strip of light emitting diodes 120 utilized with the split rail frame member arrangement 76.

In a further embodiment, the assembly 10 may include an elongated divider rail which accepts the panel, graphics and an LED strip on one or both sides, and allow multiple panels to be illuminated with graphics that may be changes individually.

Assembly of the multi-component frame arrangement 10 is accomplished, as shown in FIG. 7, by providing a mitered end (or 45 degree cut, for example, for four sided rectilinear frame assemblies) on each of the single frame members 12 and on each end of the components (74, 76 and 78) of the split rail frame member arrangement 14. A pair of "L"-shaped corner brackets 150 are placed in the respective bracket receiving channels 48 and 56 of the single frame members 12 and their respective adjacent elongated first or front side split rail 72 and 74 and their elongated second or rear side split rail corner bracket receiving channels 94. Securement members 160, such as for example, a bolt, a screw or locking pin or the like may be placed threadedly through the respective ends of a single frame member 12 into adjacent single frame securement member channels 32 and between the mid-rail member 76 and adjacent single frame members 12, as represented in FIG. 7, so as to ensure their structural integrity.

Figure 8A:
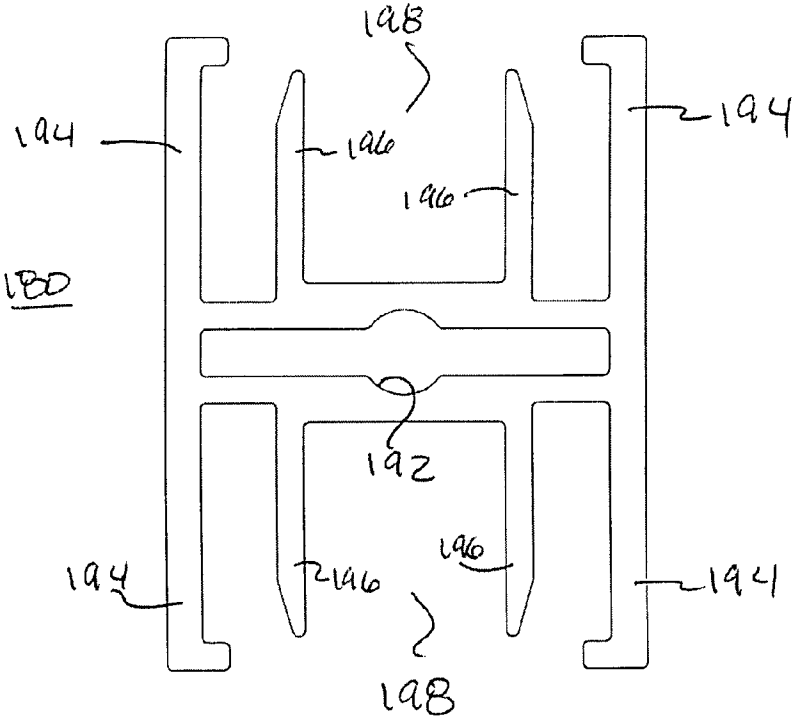
FIG. 8A is an end view of a frame assembly cross-member for use in dividing up the presentation area of frame assembly into two or more subdivisions.
Figure 8B:
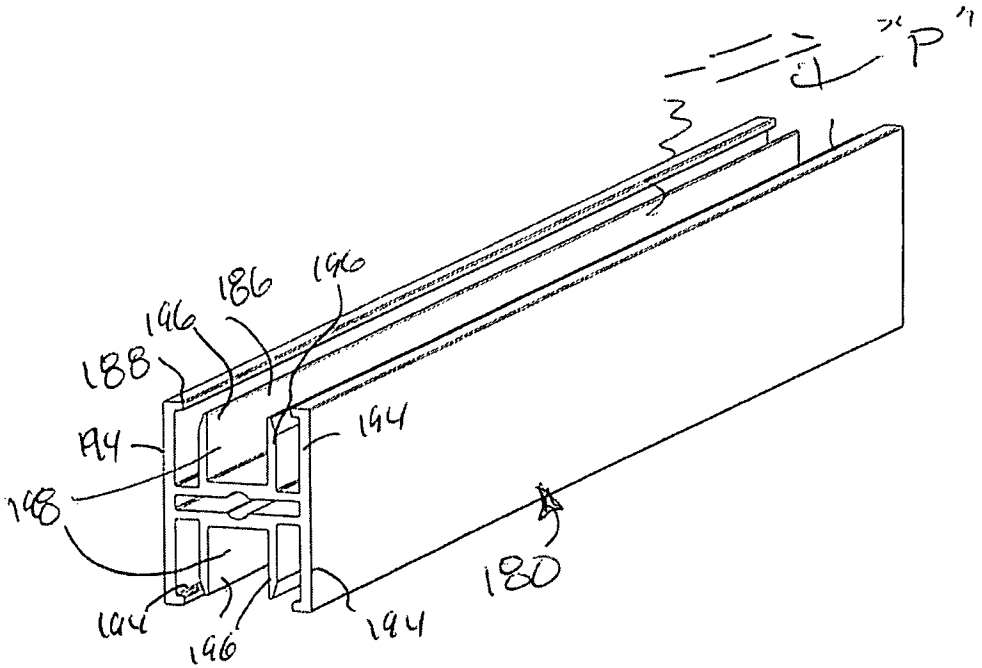
FIG. 8B is a perspective view of the cross-member represented in FIG. 8A.
Figure 8C:
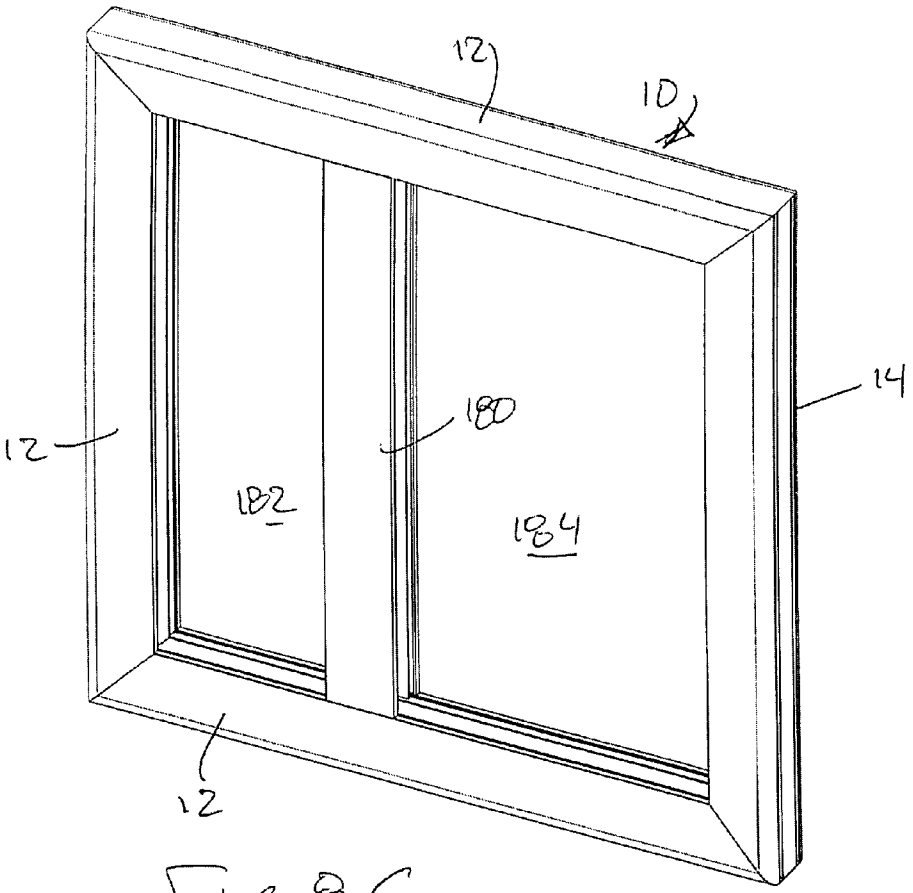
FIG. 8C is a perspective view of a frame assembly of the present invention with a cross-member shown dividing up the presentation area thereof into several sub-areas.

FIG. 8A shows an end view of a frame assembly cross-member 180 for use in dividing up the presentation area of frame assembly 10 into two or more subdivisions 182 and 184. The cross member 180 is of double "H" shape, that is, having an inner "H" 186 and an outer "H" 188 as may be seen in FIGS. 8A and 8B. The cross-member 180 has a bridge portion 190 which is common to both the inner "H" 186 and the outer "H" 188. The bridge 190 has a securement channel 192, and is arranged to receive a securement member such as for example, a bolt, a screw or locking pin or the like, not shown, through the single frame members 12. The flanges 194 of the outer "H" member 188 and the inner flanges 196 of the inner "H" member define receiving channels 198 therebetween as shown in FIGS. 8A and 8B, for receipt of a panel P, represented in phantom in FIG. 8B.

Figure 11:
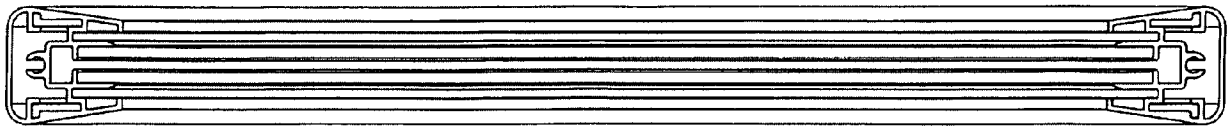
FIG. 11 is a view of the single frame member showing an inward side thereof.
Figure 9:
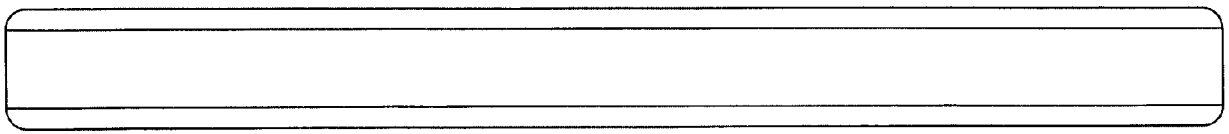
FIG. 9 is a view of the single frame member showing an outer side thereof.
Figure 10:
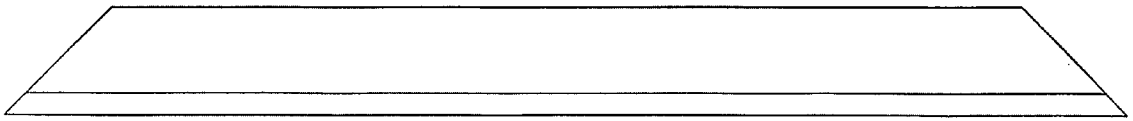
FIG. 10 is a view of the single frame member shown in FIG. 9 showing a front side thereof.
Figure 12:
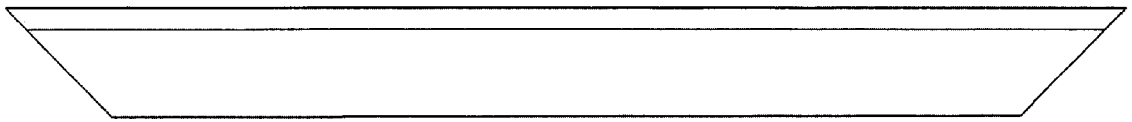
FIG. 12 is a view of the single frame member shown in FIG. 9 showing a rear side thereof.
Figure 15:
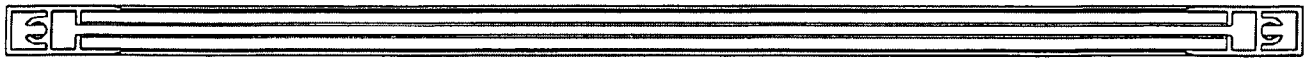
FIG. 15 is a view of the inner edge of an elongated mid-rail member shown in FIG. 13.
Figure 13:
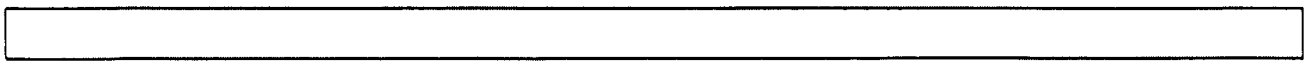
FIG. 13 is an end view of the outer side of an elongated mid-rail member.
Figure 14:
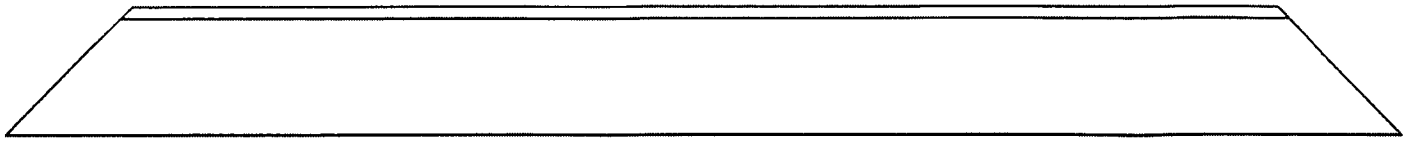
FIG. 14 is a side view of a first side of the mid-rail member shown in FIG. 13.
Figure 16:
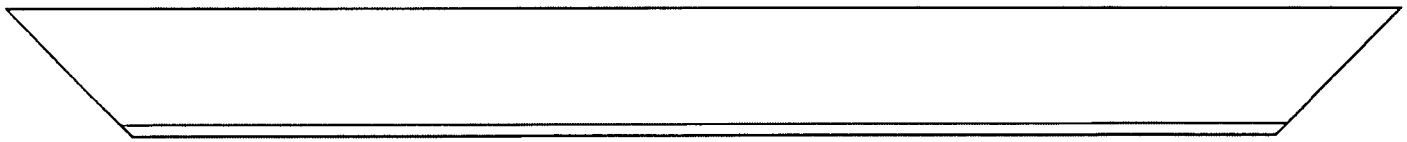
FIG. 16 is a side view of a second side of the mid-rail member shown in FIG. 13.
Figure 17:
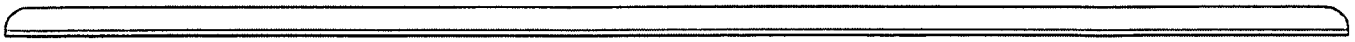
FIG. 17 is a view of the first edge of an elongated rear side split rail.
Figure 18:
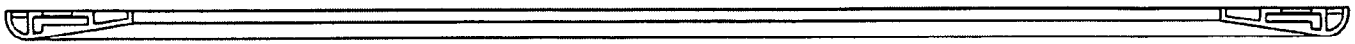
FIG. 18 is a side view of the inside of the elongated rear side split rail shown in FIG. 17.
Figure 20:
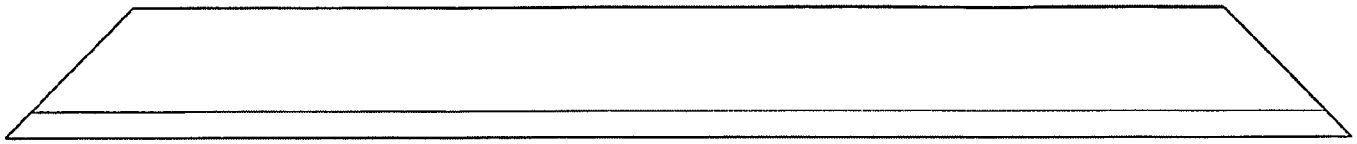
FIG. 20 is a side view of the outside of the elongated rear side split rail shown in FIG. 17.
Figure 18:
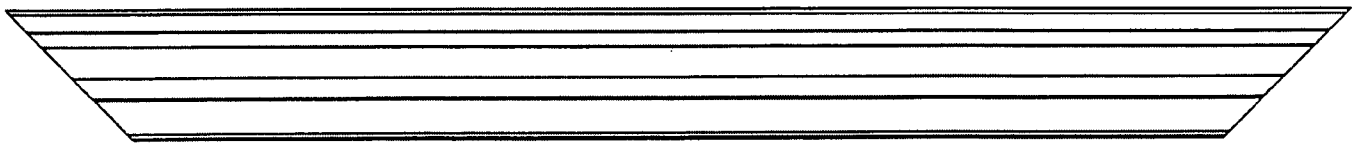
Figure 22:
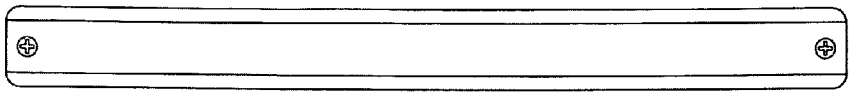
FIG. 22 is an end view of a bottom end of the multi-component frame assembly arrangements shown in FIG. 21.
Figure 21:
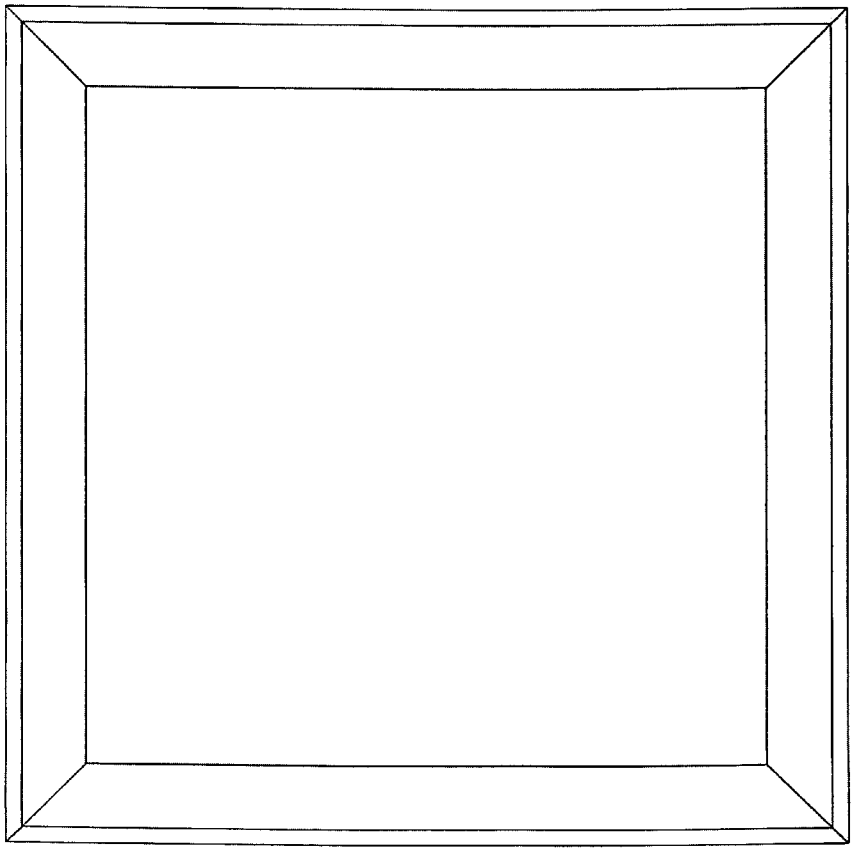
FIG. 21 is a plan view of the front face of a multi-component frame assembly arrangement shown in FIG. 1.
Figure 24:
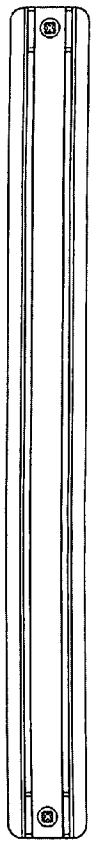
FIG. 24 is an end view all of the upper edge of the multi-component frame assembly arrangement shown in FIG. 21.
Figure 23:
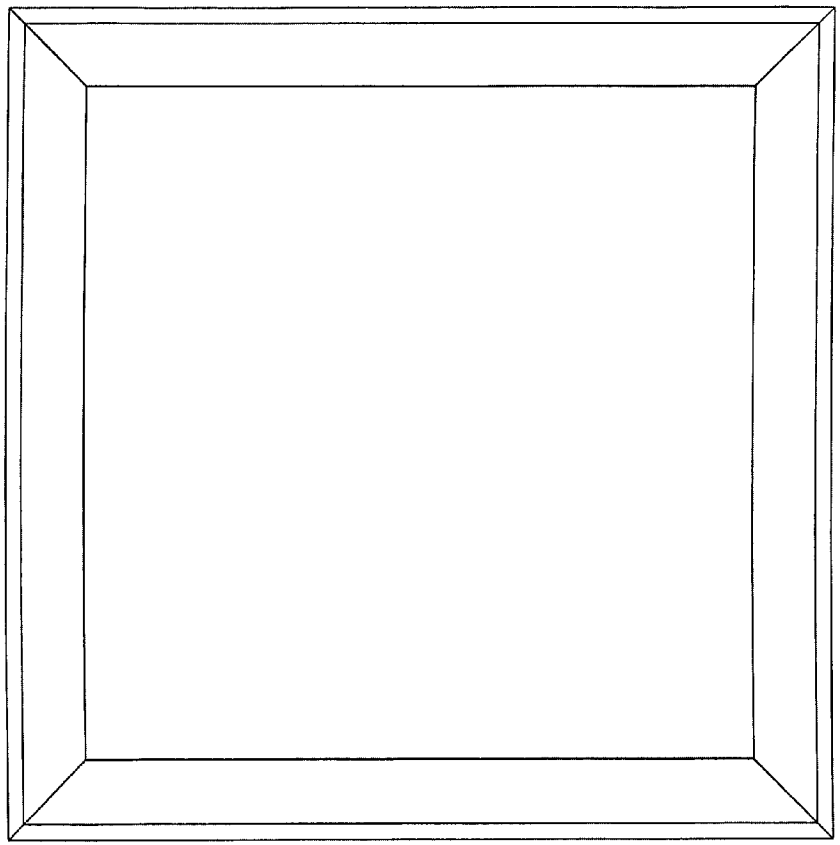
FIG. 23 is a plan view of the rear face of the multi-component frame assembly arrangement shown in FIG. 21.
Figure 25:
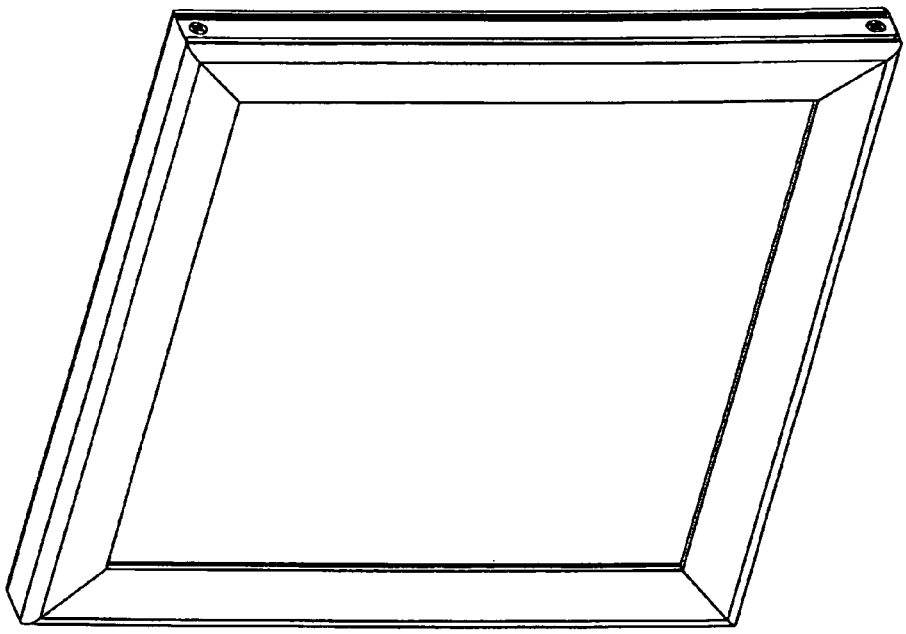
FIG. 25 is a perspective view of the multi-component frame assembly arrangement shown in FIG. 21.

FIG. 9 through FIG. 25 are shown to represent the outer configuration and unique design characteristics of the present invention. More particularly, FIG. 9 is a view of the single frame member showing an outer side thereof; FIG. 10 is a view of the single frame member shown in FIG. 9 showing a first or front side thereof; FIG. 11 is a view of the single frame member showing an inward side thereof; FIG. 12 is a view of the single frame member shown in FIG. 9 showing a second or rear side thereof; FIG. 13 is an end view of the outer side of an elongated mid-rail member; FIG. 14 is a side view of a first side of the mid-rail member shown in FIG. 13; FIG. 15 is a view of the inner edge of an elongated mid-rail member shown in FIG. 13; FIG. 16 is a side view of a second side of the mid-rail member shown in FIG. 13; FIG. 17 is a view of the first edge of an elongated rear side split rail; FIG. 18 is a side view of the inside of the elongated second or rear side split rail shown in FIG. 17; FIG. 19 is a edge view of the second edge of the elongated second or rear side split rail shown in FIG. 17; FIG. 20 is a side view of the outside of the elongated second or rear side split rail shown in FIG. 17; FIG. 21 is a plan view of the first or front face of a multi-component frame assembly arrangement shown in FIG. 1; FIG. 22 is an end view of a bottom end of the multi-component frame assembly arrangements shown in FIG. 21;

FIG. 23 is a plan view of the second or rear face of the multi-component frame assembly arrangement shown in FIG. 21; FIG. 24 is an end view all of the upper edge of the multi-component frame assembly arrangement shown in FIG. 21; and FIG. 25 is a perspective view of the multi-component frame assembly arrangement shown in FIG. 21.

We claim:

1. A multi-component frame assembly arrangement for the display of at least one graphic panel slidably insertable and removable with respect thereto, the frame assembly arrangement comprising:

a frame perimeter comprised of at least one single frame member and at least one split rail frame member arrangement, wherein the at least one single frame member and the at least one split rail frame member arrangement are joined together by a plurality of connecting brackets;

the at least one single frame member having a cross-sectional configuration of generally "U" shape, and being comprised of an exterior bridge member and an interior bridge member; wherein the interior bridge member of the mid-rail member has a bracket channel on one side of the interior bridge member and a graphic receiving channel on the other side of the interior bridge member; and wherein the mid-rail member includes an interior bridge having a securement channel co-extruded therewith; and wherein the at least one split rail member is comprised of an elongated second side split rail and elongated first side split rail each spaced-apart from an elongated mid-rail member disposed therebetween.

2. The multi-component frame assembly arrangement for the display of at least one graphic panel slidably insertable and removable with respect thereto, as recited in claim 1, including a rear second side guide and a front first side guide extending therefrom to enable secure receipt of at least one illuminable panel therewithin.

3. The multi-component frame assembly arrangement for the display of at least one graphic panel slidably insertable and removable with respect thereto, as recited in claim 2, wherein the second side guide and the first side guide each have an inner landing extending therealong.

4. The multi-component frame assembly arrangement for the display of at least one graphic, as recited in claim 3, wherein the second side guide and the first side guide are each arranged to support an elongated strip of light emitting diodes thereagainst.

5. The multi-component frame assembly arrangement for the display of at least one graphic panel, as recited in claim 4, wherein the interior bridge member includes a securement member receiving channel.

6. The multi-component frame assembly arrangement for the display of at least one graphic panel, as recited in claim 1, wherein the split rail member is arranged on a second side portion of the frame assembly.

7. The multi-component frame assembly arrangement for the display of at least one graphic panel, as recited in claim 6, wherein the elongated second side split rail is supportively disposed in a spaced-apart manner from the mid-rail member, to enable a graphic display panel to be inserted therebetween.

8. The multi-component frame assembly arrangement for the display of at least one graphic panel, as recited in claim 6, wherein the elongated first side split rail is supportively disposed in a spaced-apart manner from the mid-rail member, to enable a graphic display panel to be inserted therebetween.

9. The multi-component frame assembly arrangement for the display of at least one graphic panel, as recited in claim 1, wherein the interior bridge of the mid-rail member has a mid-member second side guide and a mid-member front side guide.

10. The multi-component frame assembly arrangement for the display of at least one graphic panel, as recited in claim 9, wherein the second side guide and the first side guide each have an inner landing member extending towards one another.

11. The multi-component frame assembly arrangement for the display of at least one graphic panel, as recited in claim 10, wherein the inner landing member of both the second side guide and the first side guide commonly support an elongated strip of light emitting diodes.

12. The multi-component frame assembly arrangement for the display of at least one graphic panel, as recited in claim 11, wherein the interior bridge of the mid-rail member and the inner landings there adjacent define a space for a wire connector arrangement to empower the light emitting diodes.

13. The multi-component frame assembly arrangement for the display of at least one graphic panel, as recited in claim 10, wherein the elongated second side split rail and the elongated first side split rail are mirror images of one another.

14. The multi-component frame assembly arrangement for the display of at least one graphic panel, as recited in claim 13, where at least one graphic panel is placed within the frame assembly arrangement and slid into a graphic receiving channel arranged on at least one single frame member.

15. The multi-component frame assembly arrangement for the display of at least one graphic panel, as recited in claim 1, including a frame display divider member with an inner "H" and an outer "H" configuration.

16. The multi-component frame assembly arrangement for the display of at least one graphic panel, as recited in claim 15, wherein the divider member has a bridge portion which is common to both the inner "H" and the outer "H".

17. The multi-component frame assembly arrangement for the display of at least one graphic panel, as recited in claim 16, wherein the bridge portion has a securement channel centrally disposed therein and is arranged to receive a securement member.

18. A method of illuminably displaying at least one graphic panel in a illuminable frame assembly comprising connecting at least one split frame member at both of its respective ends thereof, to a single-frame member, wherein the at least one split frame member consists of a first side elongated split rail and a second side elongated split rail each held in a graphic-display entrance-permitting spaced-apart relationship, with respect to and parallel to an elongated intermediately-disposed mid-rail member to provide two elongated access slots for one or two graphic displays therewithin, which mid-rail member includes an exterior bridge and an interior bridge having a securement channel co-extruded therewith;

wherein the at least two single frame members solidly connect to the first and second side elongated split rail each by a connector bracket inserted into a respective connector receiving channel on each end of the at least one spilt frame member of the at least two single frame members, wherein the at least one mid-rail member is solidly connected to the single frame members by securement means at each end, and attaching at least one elongated strip of graphic display enhancing lightable diodes to an elongated landing on at least one inwardly facing portion of at least one of the frame members.

19. The method of illuminably displaying at least one graphic panel in a illuminable frame assembly as recited in claim 18, including:

arranging a reflector panel interiorly supported by the single frame members to provide light reflection and light directional control within the frame assembly relative to a graphic display therewithin.

20. The method of illuminably displaying at least one graphic panel in a illuminable frame assembly as recited in claim 19, including:

placing an illuminable panel adjacent the reflector panel within the frame assembly.

21. The method of illuminably displaying at least one graphic panel in a illuminable frame assembly as recited in claim 20, including:

sliding a graphic display into an elongated opening between a first and/or second side elongated split rail and the mid-rail member so as to be captured within an elongated light enhancable graphic receiving space in a single frame member.

22. The method of illuminably displaying at least one graphic panel in a illuminable frame assembly as recited in claim 20, including:

energizing the light diodes so as to illuminate at least one side of the graphic display within the frame assembly.

23. A four sided frame display system for displaying one or more illuminable display panels, the frame display system comprising:

at least one single-frame member and at least one mid rail split-frame member connected together and comprising two of the four sides of the four sided frame display system, wherein the split frame member has a pair of parallel slots which permit entry and removal of one or more display panels, and the at least one single-frame member has at least two shouldered slots for receipt of the one or more display panels, wherein a pair of elongated side guides within the single-frame member support a reflector panel sandwiched between a pair of illuminable panels, which are sandwiched between the one or more display panels within the system; and wherein an elongated array of lights is arranged on a pair of spaced apart inner landings to provide illumination of the one or more display panels supported in the system.

24. The four sided frame display system as recited in claim 23, wherein the elongated array of lights are arranged adjacent at least one side of the illuminable panels.

25. The four sided frame display system as recited in claim 24, wherein the at least one split-frame member and the at least one single-frame member have a common overall peripheral configuration.

26. The four sided frame display system as recited in claim 25, wherein the at least one mid-rail split-frame member and the at least one single-frame member have an interior bridge member which includes a centrally disposed securement channel for connecting the at least one mid-rail split-frame member to the at least one single-frame member.

27. The four sided frame display system as recited in claim 26, wherein the respective one or more display panels are supported in a spaced-apart orientation from their inwardly adjacent illuminable panels.

28. The four sided frame display system as recited in claim 27, wherein a cross member is arranged to subdivide the frame display system into multiple display panel supports.

29. The four sided frame display system as recited in claim 28, wherein the cross member is comprised or two "H" configurations having a common bridge portion.

30. The four sided frame display system as recited in claim 29, wherein the two "H" configuration of the cross member has parallel spaced apart flanges for receipt of individual display panels.

* * * * *